United States Patent [19]

Birdwell

[11] Patent Number: 4,541,779

[45] Date of Patent: Sep. 17, 1985

[54] MUD PUMP

[76] Inventor: J. C. Birdwell, 8535 Glencrest, Houston, Tex. 77061

[21] Appl. No.: 455,509

[22] Filed: Jan. 4, 1983

Related U.S. Application Data

[63] Continuation-in-part of Ser. No. 133,948, Mar. 25, 1980, abandoned, Ser. No. 309,979, Oct. 8, 1981, abandoned, Ser. No. 220,527, Dec. 29, 1980, abandoned, and Ser. No. 348,497, Feb. 11, 1982, abandoned.

[51] Int. Cl.[4] ..... F04B 23/06; F04B 9/10

[52] U.S. Cl. ..... 417/62; 417/342; 417/390; 417/454; 417/552; 91/39; 92/171

[58] Field of Search ..... 417/454, 569, 62, 390, 417/549, 552, 553, 554, 342; 91/39; 92/169, 171

[56] References Cited

U.S. PATENT DOCUMENTS

| | | | |
|---|---|---|---|
| Re. 26,820 | 3/1970 | Bennett | 417/347 |
| 564,112 | 7/1896 | Sheff et al. | 91/270 |
| 1,851,801 | 3/1932 | Boone | 91/39 |
| 2,168,131 | 8/1939 | Mader | 92/171 |
| 2,198,301 | 4/1940 | Campbell | 92/171 |
| 2,402,300 | 6/1946 | Shimer | 91/39 |
| 3,022,738 | 2/1962 | Krute | 91/39 |
| 3,098,449 | 7/1963 | Hill | 417/62 |
| 3,123,007 | 3/1964 | Orr | 91/39 |
| 3,295,451 | 1/1967 | Smith | 417/347 |
| 3,887,305 | 6/1975 | Ito | 417/439 |
| 4,184,411 | 1/1980 | Morris | 92/171 |

FOREIGN PATENT DOCUMENTS

| | | | |
|---|---|---|---|
| 589947 | 6/1925 | France | 417/552 |

*Primary Examiner*—Leonard E. Smith
*Attorney, Agent, or Firm*—Vaden, Eickenroht, Thompson, & Jamison

[57] ABSTRACT

A multicylinder, hydraulic driven, dual arranged mud pump is disclosed. The preferred embodiment consist of dual mud pumping units arranged to be selectively operated as individual pumps, as two pumps whose output flow is in parallel, or as two pumps whose output flow is in series. Each mud pumping unit is comprised of plural pumping assemblies with each assembly consisting of a pair of separate end to end cylinders, one cylinder being arranged to be driven by a second cylinder with the one cylinder further being arranged to pump mud and the second cylinder being arranged to be reciprocally driven in a sequential manner by pressurized hydraulic fluid. The pressurized hydraulic fluid is supplied to all operating second cylinders from common pressurized fluid source with the pressurized fluid being distributed to and returned from the second cylinder by an independently operated distribution valve, the volume of pressurized fluid flow being employed to synchronize the stroke and control the stroke length of the second cylinder which in turn controls the volume of pumped mud.

50 Claims, 8 Drawing Figures

MUD PUMP

REFERENCE TO OTHER APPLICATIONS

The present application is a continuation in part of copending application Ser. No. 06/133,948, filed Mar. 25, 1980, now abandoned; application Ser. No. 06/309,979, filed Oct. 8, 1981, now abandoned; application Ser. No. 06/220,527 filed Dec. 29, 1980 now abandoned; and application Ser. No. 06/348,497 filed Feb. 11, 1982, now abandoned.

It is the object of the present application to provide an improved and extended application of the hydraulic drive system disclosed in the above patent application, additionally to provide an improved variation of the mud pumping cylinders of the above patent application.

BACKGROUND OF THE DISCLOSURE

The improved mud pump according to this invention has many and varied useful applications including the pumping of drilling mud used during the drilling of oil wells. Most mud pumps known in the art are piston pumps that have limited capabilities pressure wise and flow wise when pumping with a given piston size. The pump according to the present invention is a pump capable of an extended range of flow and pressure output capacity with non pulsating output characteristice.

The pump according to the present invention is likewise subject to better adaptability, performance, and maintenance than convential pumps thus making it suitable for such applications as helicoptor rigs where all the oil well drilling equipment must be transported into remote areas by helicopter.

DETAILED DESCRIPTION OF THE PREFERRED EMBODIMENT

Figure 1:
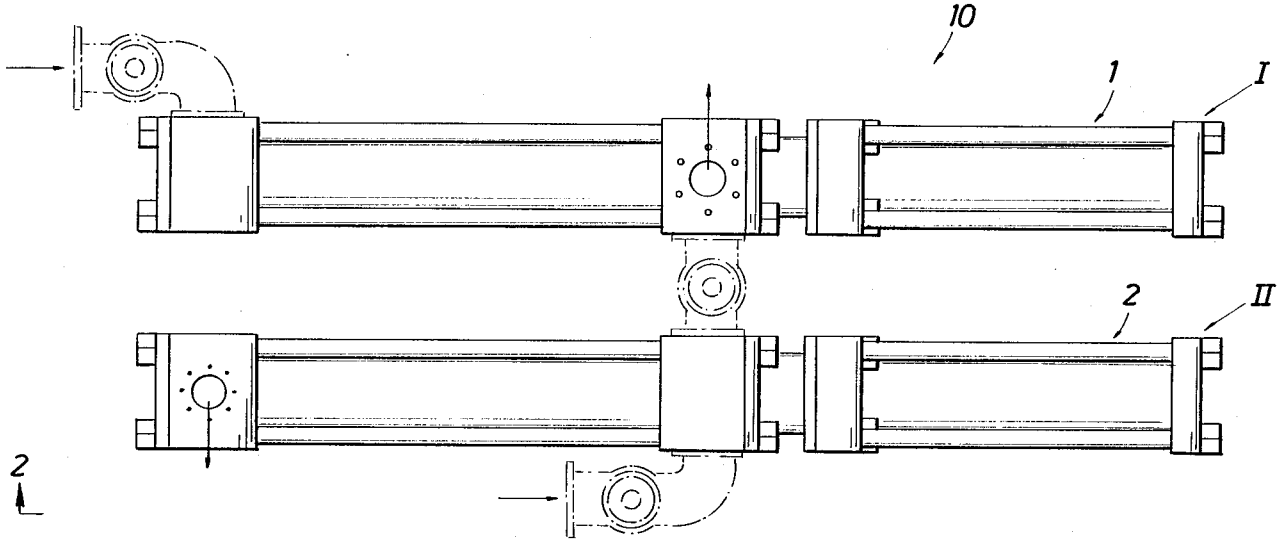
FIG. 1 is a plan view of a multicylinder mud pump in accordance with the teachings of the present invention. The hydraulic supply and distribution system is not shown in this plan view.
Figure 2:
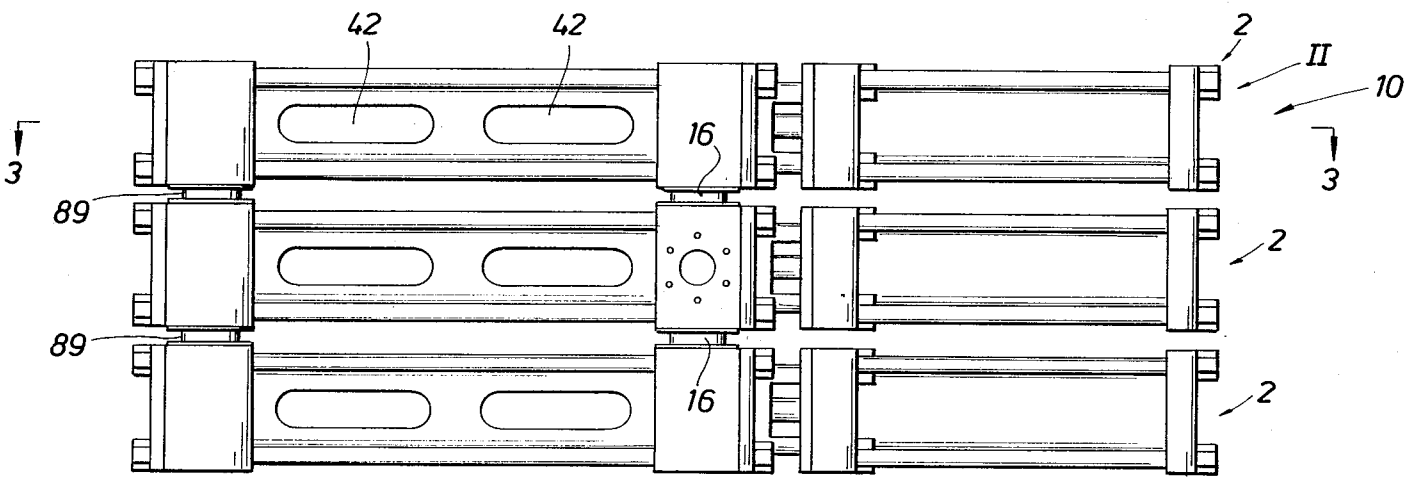
FIG. 2 is a elevation view of FIG. 1 looking along the line 2—2 of FIG. 1.

Attention is first directed to FIG. 1 and FIG. 2 of the drawings where the numeral 10 generally identifies the mud pump of the present invention. FIG. 1 is a plan view and FIG. 2 is an elevation view taken along the lines 2—2 of FIG. 1. In this illustrated embodiment a mud pump is shown that employes two pumping units, with each pumping unit being comprised of three pumping sections. In FIG. 1 and FIG. 2 the numeral 1 generally identifies a first pumping unit and the number 1 generally indentifies a pumping section of the first pumping unit, likewise the numeral II generally identifies a second pumping unit and the number 2 generally identifies a pumping section of the second pumping unit. Three or more pumping sections per pumping unit is the preferred arrangement of this pump.

Figure 3:
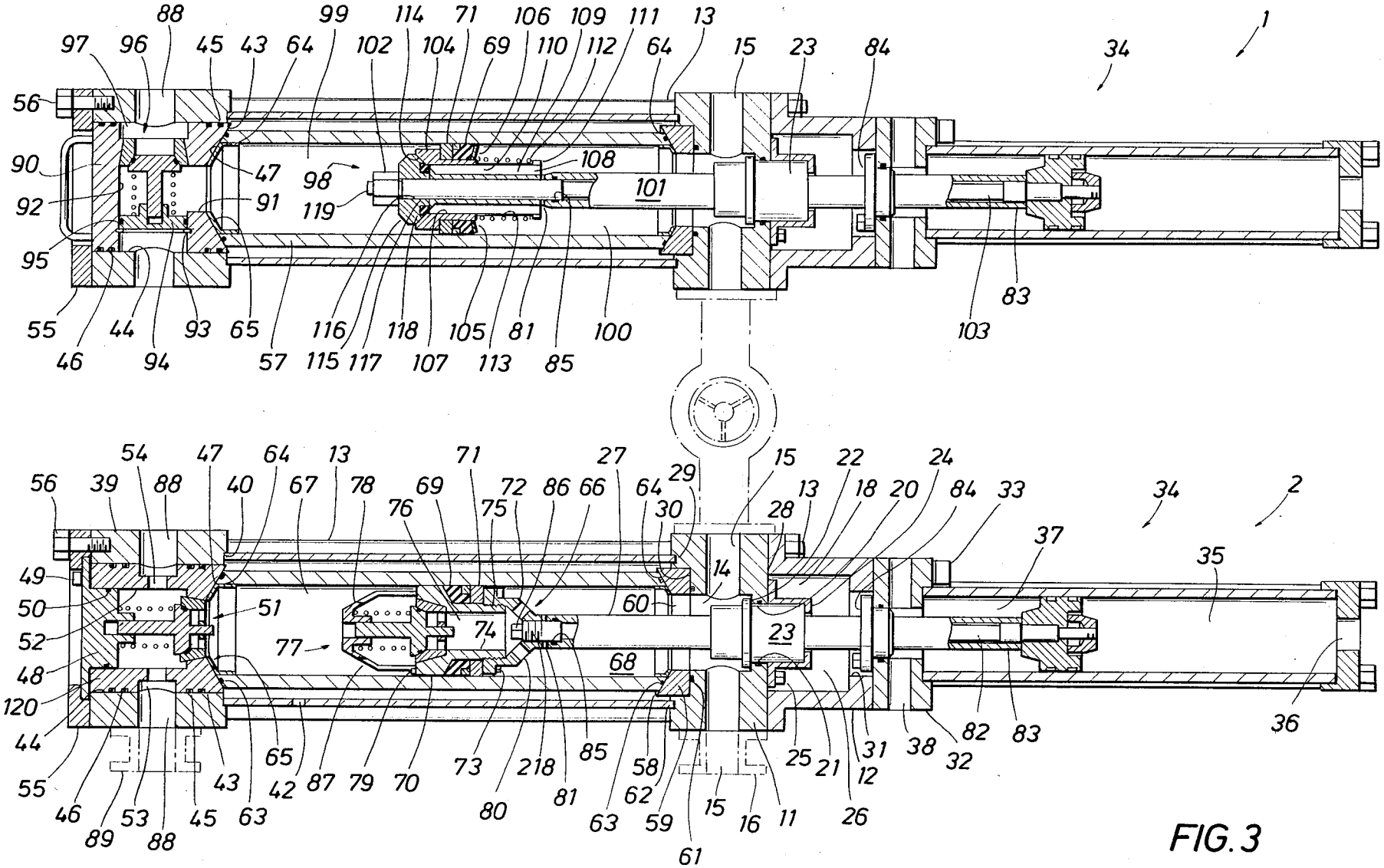
FIG. 3 is a section view taken along the line 3—3 of FIG. 2.

Attention is next directed to FIG. 3 which is a section view taken along the lines 3—3 of FIG. 2 which shows a pumping section 1 of the first pumping unit and a pumping section 2 of the second pumping unit. It will be noted that most component parts of pumping sections 1 and pumping section 2 are generally the same, except the arrangement thereoff pumping section 1 to pump with the piston rod in tension, and the arrangement thereoff pumping section 2 to pump with the piston rod in compression. Therefore, a generally descriptive discussion of the parts of section 2 will be covered, with the discussion of the component parts of section 1 generally be limited only to parts that are different. Likewise, it will be understood that corresponding numbers of like components will apply to both sections 1 and section 2.

To this end, attention is directed to pumping section 2 of FIG. 3 where a central flange 11 retains a cylinder adaptor flange 12 by tie rods 13 which pass therethrough flange 11. Flange 11 is generally a squared flange type member with a rounded bore 14 therethrough. Fluid port 15 leads through the side and into bore 14. Fluid port 15 is supplied on its outer end with recessed threaded holes for attachment of sealed fluid flange connections. Fluid port 15 is sealingly connected by a flanged member 16 between all sections of a pumping unit to give a common annular fluid communication therebetween. Additionally one or more ports 15 is sealingly connected to a fluid supply or fluid outlet line as may be directed by the pumping arrangement. Thusly, fluid port 15 may consists of one, two, or more ports arranged through the sides of flange 11.

Central flange 11 additionally has a finely finished central bore 20 therethrough which contains a recessed seal element 21 and a shoulder 22 which sealingly and slideably accept a rod seal cartridge 23, a seal retainer flange 24 bolts to flange 11 by bolts 25, and bolts to seal cartridge 23 by bolt 26 to securely retain seal cartridge 23. Seal cartridge 23 houses a piston rod 27 which sealingly passes centrally therethrough. Inlet flange 11 further contains recessed bores 28, 29 and 30, which each is concentric to the centerline of bore 20 and to the centerline of piston rod 27.

Cylinder adaptor flange 12 has on one end a rounded boss that mates with bore 28 of inlet flange 11 to centrally align flange 12, also flange 12 has a finely finished central bore 31 upon its other end into which is fitted a cylinder head flange 32 that is retained by bolts 33 which pass through flange 32 and attach by threads to flange 12, flange 32 concentrically aligns and carries a hydraulic drive cylinder 34 with piston rod 27. Cylinder 34 has an expansion chamber 35 containing fluid inlet 36 and an expansion chamber 37 having fluid inlets 38. Cylinder 34 is of standard type construction that is well known in the art except for the piston rod, so the remaining parts of cylinder 34 will not be described other than the piston rod which will be discussed later.

Tie rods 13 extend outward from flange 11 and are connected by threads to a head flange 39, head flange 39 containes a recessed groove 40 into which is fitted one end of a spacer cylinder 41. The other end of cylinder 41 is fitted into recessed groove 29 of flange 11. The two ends of cylinder 41 are formed concentric and are squared relative to the centerline therethrough, thus flange 11 and flange 39 are positioned accordingly and securely retained in place by tie rods 13. Spacer cylinder 41 contain access ports 42 formed through one side thereoff. Head flange 39 contains a central bore therethrough that is concentric to recessed groove 40 and that has a finely finished surface of slightly differing diameters at 43 and 44. The diameter at 44 being larger than the diameter at 43. Within the central bore of flange 39 is slideable fitted an outlet valve housing 120 which contains seals 45 and seals 46 with seal 45 making sealing alignment contact with surface 43 and seal 46 making sealing alignment contact with surface 44. The inward end of member 120 is formed with a cone like taper 47 with the centerline of taper 47 being concentric to the bores formed by surface 43 and 44. Member 120 further contains a bore 52 centrally positioned therethrough which is fitted at its outer end with a retainer cap 48 that is sealingly connected to member 120 by bolts 49 and seal 50. The second end of bore 52 exits at the cone like tapered end of member 120 and is formed to receive an outlet valve 51. Valve 51 being a standard type mud pump outlet valve that is well known in the art and thus requires no further description. Member 120 also has a groove 53 formed in its circumference with groove 53 making annular communication with bore 52 through holes 54 that lead through the sides of member 120. Groove 53 additionally make annular communication with fluid ports 88 that are formed through the side of member 39. Groove 53 is positioned between seals 45 and 46 to thusly provide a sealed fluid communication from valve 51 to port 88. Retainer plate 48 and thus member 120 is retained within head flange 39 by a retainer plate 55 that tightens against member 48 by threaded lugs 56 which are attached to the end of member 39 and pass therethrough member 55.

Fluid port 88 leading through the side of head flange 39 and into the central bore of flange 39 is supplied on its outer end with recessed threaded holes for attachment of sealed fluid flange connections. Fluid port 88 is sealingly connected by a flanged member 89 between all sections of a pumping unit to give a common annular fluid communication therebetween. Additionally one or more ports 88 is sealingly connected to a fluid supply or fluid outlet line as may be directed by the pumping arrangement. Thusly, fluid bore 88 may consists of one, two, or more ports arranged through the sides of flange 39.

A replaceable mud pumping liner 57 is positioned inward from member 120. Liner 57 is a rounded cylinder with a central bore therethrough and contains cone like tapers on each end. The taper on one end of member 57 being formed to mate with taper 47 of member 120, and the taper on the other end being formed to mate with a corresponding taper 58 that is concentrically formed within a replaceable end ring member 59. End ring member 59 being slidable and centrally mounted within recess 30 of inlet flange member 11. Member 59 has a central bore 60 therethrough and makes sealing contact with seal 61 that is mounted in a recessed groove in member 11. Member 59 is retained in recess 30 by a set screw 62 that is located in member or cylinder 41.

Pumping liner 57 further has a seal 63 that is mounted in a groove that is recessed inward from the face of the cone like taper on each end. Additionally liner 57 has a lesser tapered surface 64 on each end to facilitate piston packer insertion therethrough. A wear ring 65 is mounted of the outer end of liner 57, being retained in place by the lesser tapered surface 64 of liner 57. Pumping liner 57 is sealingly aligned and retained in place by clamping pressure applied by lugs 56. The cone like tapers on each end of liner 57 are aligned concentric to the central bore therethrough.

The central bore therethrough of liner 57 houses a piston and valve assembly 66 which divides the central bore into an outlet compression chamber 67 and an inlet expansion chamber 68. Chamber 67 leading to outlet valve 51 and chamber 68 leading to fluid port 15. Assembly 66 is connected by threads to piston rod 27 and contains a packer seal 69 that is mounted on a valve housing 70 and retained in place by a wear ring 71 that bolts to an adaptor member 72 by bolt 73. Member 71 being retained from turning by a pin 74 that fits in a groove in member 70. Member 72 attaches to member 70 by thread 75 and is then locked to member 71 by bolts 73 to prevent loosening of thread 75. Member 70 has a bore 76 therethrough which is concentrically positioned with respect to piston rod 27 and which is formed on it outer end to accept an inlet valve assembly 77 that is retained in place by end cap 78, end cap 78 having slots 87 therethrough for fluid passage and being aligned concentric to bore 76 and being attached to member 70 by bolts 79. Bore 76 on its inner end makes annular communication with chamber 68 through ports 80 leading through the sides of member 72.

Inlet valve 77 is standard type mud pump inlet valve with the art being well known thus is not necessary to fully discribe its parts and construction. Valve 77 is positioned to allow flow from chamber 68 to chamber 67 and to block flow in the opposite direction, likewise valve 51 is positioned to allow flow from chamber 67 to annular 52 and to block flow in the opposite direction.

Piston assembly 66 is attached to piston rod 27 by threads 218 and by lockwasher 81. Piston rod 27 being comprised of two members, an inner rod 82 and an outer replaceable sleeve 83. Inner rod 82 is securely connected to the drive piston of cylinder 34 and is formed to closely accept the slideable insertion of member 83 onto its outer circumference, with member 83 starting within cylinder 34 and extending through cylinder rod seal 84 and through seal 23 and into chamber 68. Member 83 being compressely secured in place by member 66 tightening upon rod 82. Piston rod 27 further contains a seal 85 to sealingly separate cylinder 34 from chamber 68. Inner rod 82 contains a hex 86 formed upon its end to facilitate tightening of thread 218.

Thus according to the foregoing description of pumping section 2, three so described pumping sections are connected in parallel to form the typical pumping unit as illustrated in FIG. 2. Fluid port 15 is connected to a fluid supply source, and fluid port 88 is connected to an outlet supply line. Thus as piston rods 27 are reciprocally driven, fluid flow will be pulled through port 15 into chamber 68, thence through valve 77 and into chamber 67. Likewise fluid will be forced from chamber 67, through valve 51 and out through port 88. Three or more pumping sections are utilized so that the movement of piston rod 27 can be synchronized and overlapped in a manner to cause the outlet flow through port 88 to be of a non-pulsating nature.

Attention is further directed to FIG. 3, pumping section 1, where the central bore of head flange 39 is slidably fitted with an inlet valve housing 90 that contain seal 45 and seal 46 which make sealing alignment contact with bore 43 and 44. The inward end of member 90 is formed with a cone like taper 47 with the centerline of taper 47 being concentric to bores 43 and 44. Member 90 further contains a central recessed bore 91 leading inward from the tapered end and making annular communication with a side bore 92 that is formed therethrough member 90. Bore 92 being a rounded bore fitted at one end with a snap ring 93 which retains a spring retainer plate 94. Plate 94 contains a recessed seal 95 and fits slidably and sealingly within bore 92. The other end of bore 92 is formed to receive a fluid inlet valve 96. Valve 96 being a standard type mud pump inlet valve that is well known in the art and thus requires no further explanation. Member 90 further contains a groove 97 formed in its outer circumference with groove 97 making annular communication with bore 88 and the inlet to valve 96. Bore 91 and groove 97 are formed between seal 45 and seal 46. Inlet valve 96 is positioned within member 90 to allow fluid flow from port 88 to bore 91 and to block flow in the opposite direction. Member 90 is retained within head flange 39 by retainer plate 55.

Member 90 sealingly aligns and retaines in place piston liner 57 which houses a piston and valve assembly 98 that divides liner 57 into an inlet expansion chamber 99 and an outlet compression chamber 100. Chamber 99 leading to inlet valve 96 and chamber 100 leading to fluid port 15. Assembly 98 is retained by threads upon a piston rod 101 by a bolt 102. Piston rod 101 is comprised of an outer sleeve 83 and an inner rod member 103. Inner rod 103 is securely connected to the drive piston of cylinder 34 and is formed to closely accept the slidable insertion of member 83 onto its outer circumference, with member 83 starting within cylinder 34 and extending through cylinder rod seal 84 and through rod seal 23 and into chamber 100 and being secured in place by piston assembly 98 pressing against lockwasher 81. Piston rod 101 further contains a seal 85 to sealingly separate chamber 100 from cylinder 34.

Piston and valve assembly 98 is comprised of a pliable packer element 69 and a wear ring 71 that is slidably inserted onto a packer housing 104 and retained in place by a cone shaped end plate 105 and a snap ring 106. Member 104 has a closely finished central bore which is slidably fitted onto the outer circumference of an inner member 108, member 108 being closely and slidably fitted to piston rod 103 with the outer circumference of member 108 being concentric to the centerline of piston rod 103. Member 108 is an elongated circular member with a central bore therethrough and having several rib members 109 extending outward that allows a flow passage 110 therebetween, a raised circular ring 111 is formed on one end of member 108 which accepts a spring 112. Member 104 slidably inserts upon the second end of member 108 with the movement of member 104 being limited by a shoulder 113 that is formed on members 109. Member 104 further has a hardened and finely finished cone like tapered surface 114 formed upon one end that mates with a corresponding surface that is formed upon a valve plug member 115. Member 115 being concentrically positioned upon rod 103 by a bore 116 therethrough which contains a rod seal 117. Member 115 further contains a pliable seal element 118 that is retained in place by member 108 and that effectively seals chamber 100 from chamber 99 whenever the conical faces of member 104 and 115 are pressed together. Piston rod 103 has a hex 119 formed upon its end to facilitate the tightening of nut 102 to retain piston and valve assembly 98 in place.

Thus from the foregoing description of pumping section 1, it is observed that with a fluid inlet supply source connected to fluid port 88, a fluid outlet line connected to fluid port 15, and piston rod 101 reciprocally driven, then fluid will be drawn across inlet valve 96 and into chamber 99, then forced through piston and valve assembly 98 into chamber 100 and thus on out through fluid ports 15 to the outlet line. Three sections of pumping section 1 are connected in parallel, corresponding to the prior description of the connection of three members of pumping section 2, to form pumping unit No. I; However, as noted pumping unit No. I has the fluid flow direction reversed from that of prior described pumping unit No. II.

Figure 5:
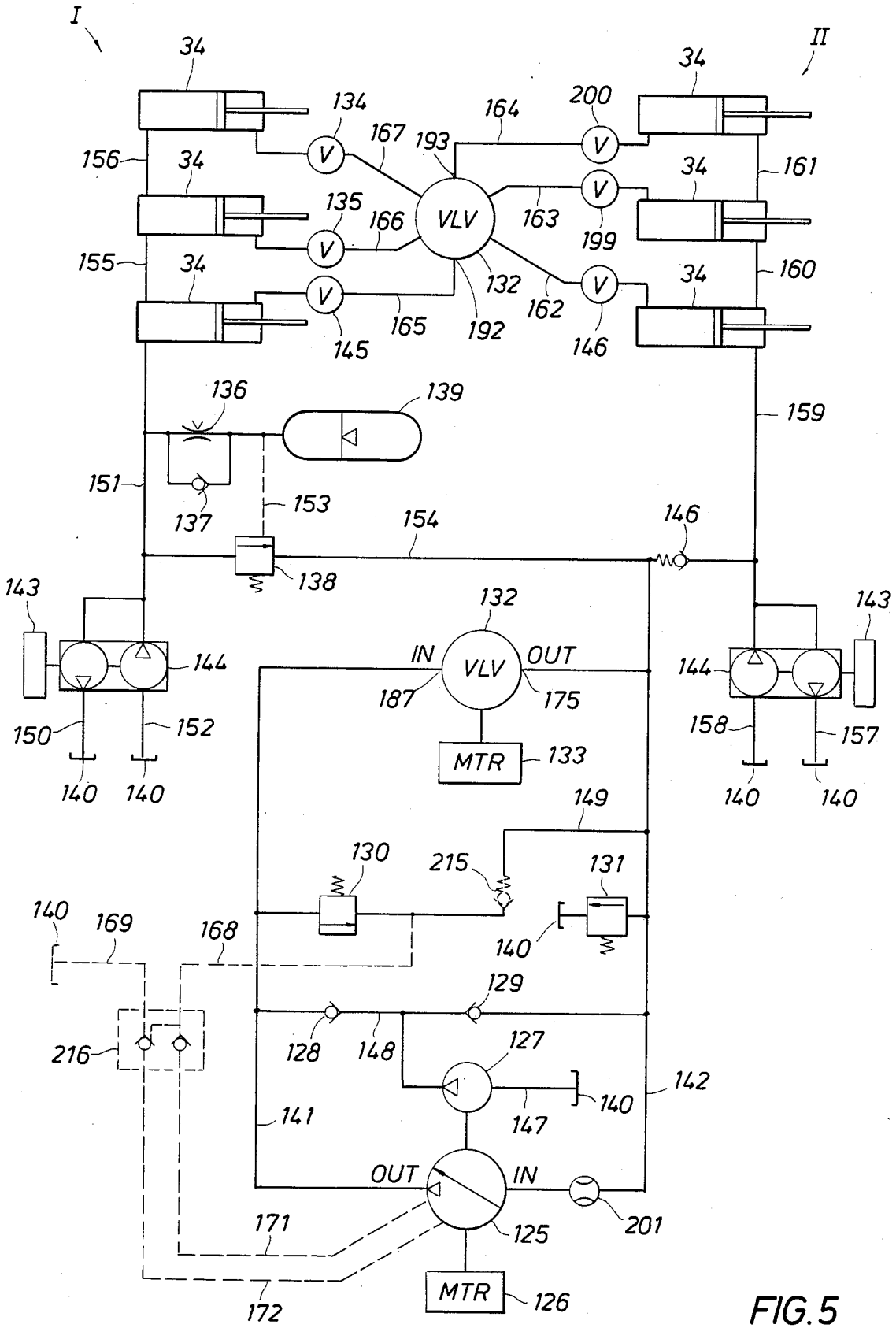
FIG. 5 is a schematic drawing showing a typical hydraulic system and power system used to power a mud pump of the present invention.

Attention is next directed to FIG. 5 which is a schematic drawing of a typical hydraulic circuit employed to power the hydraulic cylinder 34 of this mud pump. In this circuit the six cylinders 34 are illustrated without their connecting mud cylinders.

It will be noted that the hydraulic circuit shown in FIG. 5 is basically the same as the circuit prior disclosed in copending application Ser. No. 06/133,948, filed Mar. 25, 1980 and application Ser. No. 06/309,979, filed Oct. 8, 1981. The basic difference being that dual and separate cylinder drives are operated from the same metering valve. The metering valve being essentially the same except for internal piping that is employed to reduce the number of external hydraulic lines required.

The main components of the circuit shown in FIG. 5 are a main pump 125 that is driven by a prime mover 126, a charge pump 127 that is also driven by prime mover 126, one way check valve 128 and 129, high pressure relief valve 130. Independent driven metering valve 132 that is driven by prime mover 133, flow control valve 136, one way check valve 137, relief valve 138, pneumatic type accumulator 139, hydraulic cylinders 34, hydraulic reservoir 140, high pressure supply line 141, low pressure return line 142, drive motor 143, common driven pump and motor 144, check valve 146, hydraulic flowmeter 201, shutoff valves 134, 135, 145, 146, 199, 200, and hydraulic flow lines 147 through 172. The hydraulic system shown is a closed loop charged type hydraulic system employing a variable volume one direction main pump. Most of the components in this hydraulic circuit and the usuage thereof are well known by anyone versed in the art thus it is necessary to give detailed explanation only of unique and new pressurized fluid control means disclosed by this circuit.

Figure 6:
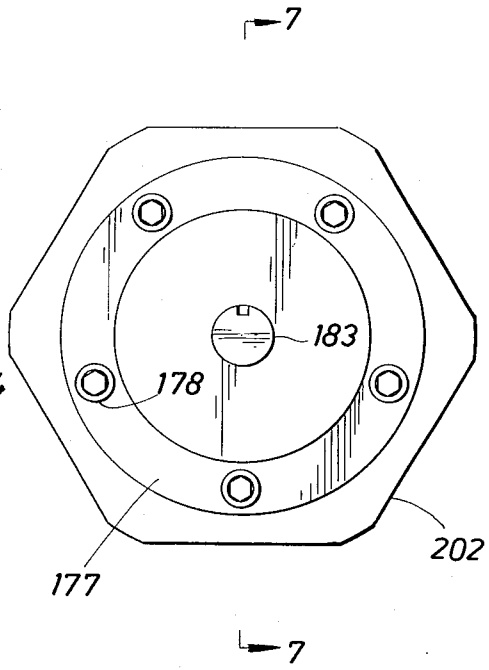
FIG. 6 is an end view of the independent driven metering valve that is used to distribute hydraulic fluid to the hydraulic drive cylinders of this pump.
Figure 7:
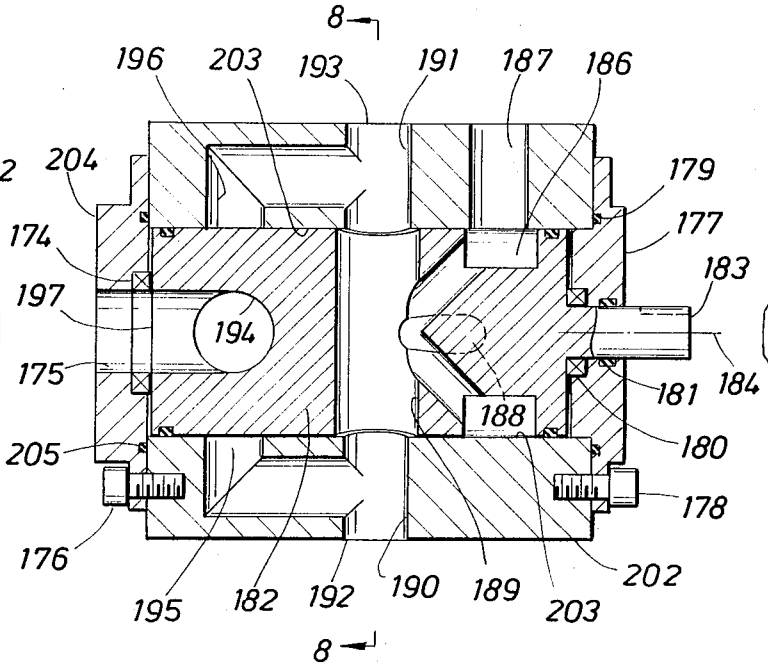
FIG. 7 is a section view taken along the line 7—7 of FIG. 6.
Figure 8:
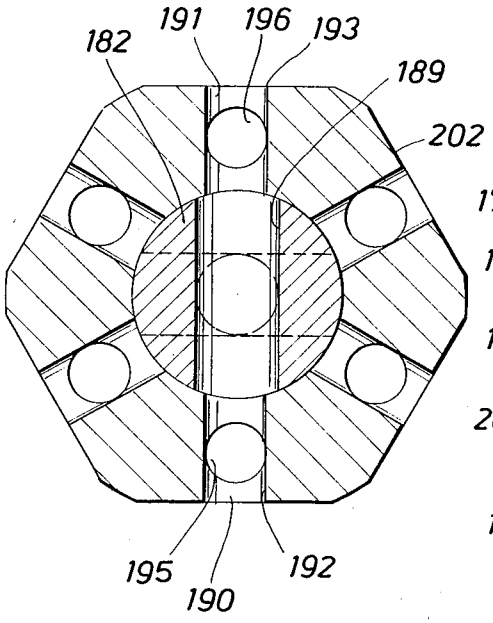
FIG. 8 is a section view taken along the lines 8—8 of FIG. 7.

Attention is further directed to FIG. 6, which is an end view of metering valve 132 of the circuit of FIG. 5. FIG. 7 is a section view shown along the lines 7—7 of FIG. 6, and FIG. 8 is a section view shown along the lines 8—8 of FIG. 7. Valve 132 contains a housing 202 with a finely finished central bore 203 therethrough. Housing 202 has an end plate 204 on one end which contains a seal 205 for sealing of flow therebetween. End plate 204 also contains a thrust bearing 174 which is fitted into a recessed counterbore for containment, and a fluid return port 175 which passes therethrough and is fitted on its outer end for receipt of hydraulic fluid return line 142. End plate 204 is retained in place by bolts 176. On the other end housing 202 has a second end plate 177 which is retained in position by bolts 178 and which retains in place a seal 179. End plate 177 also contains a central bore therethrough into which is fitted a second thrust bearing 180 and a shaft seal 181.

Mounted within bore 203 of housing 202 is a rounded rotatable valve spool 182 which is formed to make rotatable sealing contact with the walls of bore 203. Spool 182 has a drive shaft 183 of reduced diameter extending from one end which extend through the bore of plate 177 and thus through seal 181 to form a drive connection means to rotate spool 182 about its rotational centerline 184 by an external rotary drive means. Contained within spool 182 is a groove 186 that circles the circumference and continually communicates with an inlet port 187 that is positioned in housing 202 and that is fitted to receive fluid pressure line 141. Leading inward from groove 186 are rounded ports 188 which connect to a cross port 189. Cross port 189 passes through centerline 184 and is perpendicular to centerline 184 and forms two equal annular outlets from spool 182 which are at 180 degree spacing around the circumference of spool 182. Each end of cross port 189 is finely finished in a rotation wise like manner to simultaneously distribute fluid to ports 190 and 191 of housing 202. Port 190 and 191 are equal ports that are formed at 180° spacing through the sides of housing 202. The outer ends of ports 190 and 191 are formed to accept fluid flow lines at 192 and 193 respectively.

Valve spool 182 further contains a second cross port 194 therethrough whose centerline is likewise perpendicular to rotational centerline 184 of spool 182. Cross port 194 is positioned at a 90° spacing relative to the centerline of cross port 189. Each end of cross port 194 is finely finished in a rotation wise like manner to simultaneously receive fluid from port 195 and 196 of housing 202. Ports 195 and 196 are equal ports that are formed at 180° spacing into the side of housing 202. With port 195 connecting to port 190 and thus outlet 192, and port 196 connecting to port 191 and thus outlet 193. Ports 196 and 195 are in the same plane as port 190 and ports 191. The second end of valve spool 182 is fitted with recessed port 197 that is centrally located along centerline 184 and that communicates at its inner end with cross port 194. Port 197 communicates at its outer end with annulus 175 and thus with hydraulic return line 142.

Thus as valve spool 182 is rotated within housing 202, fluid lines connected at 192 and 193 will first be positioned to receive pressurized fluid from inlet port 187 and then next be positioned to exhaust fluid through exhaust port 175. Additionally, since the pressure ports are directly opposed there will be no pressure side loading applied to spool 182 when operating under pressure; further, a relative large quantity of fluid can be delivered through the ports of spool 182 since the fluid can be delivered through two outlets. Also, the rotational speed of spool 182 can be minimized since ports 190 and 191 will experience two pressure cycles per spool revolution.

Referring to FIG. 8 it will be noted that valve housing 202 is equipped with six typical side ports as prior described for port 190 or 191. Each port being spaced at a 60° spacing around the circumference of housing 202. Thus 6 cylinders can be connected to typical port 190 to be alternately pressurized and then de-pressured with two of the cylinders always being simultaneously pressurized. It will further be noted that the ends of cross ports 189 and 194 can be formed to mate with the inner ends of ports 191, 192, 195 and 196 to distribute and exhaust fluid in such a manner so that continual and practically un-restricted flow can be routed through valve 132. It will further be noted that the ends of cross ports 189 and 194 can be formed to mate with the inner ends of ports 190, 191, 195 and 196 in such a manner to finely control the starting and stopping of a fluid supply to typical port 190 and 191, also to finely control the starting and stopping of an exhaust of fluid from typical port 195 and 196; Thereby, influencing the severity of sudden pressure changes within typical port 190 and 191 as these ports are alternately pressurized and then exhausted.

It will further be noted that any one, two, or three typical ports 190 or 191 may be blocked from fluid flow therethrough and this will cause no significient detromental effect upon the operation of valve 132 or upon the hydraulic system as long as the flow can be absorbed by the opposite corresponding port 190 or 191. Thus a group of three hydraulic cylinders can be operated from typical ports 191, and a group of three cylinders can be operated from typical port 190. All Six cylinders can be operated simultaneously or either group of three cylinders can be operated individually as selected.

Reference is directed to FIG. 5 where valve 132 is illustrated in two sections, with the in and out section shown connected to the main circuit pump and the distribution section shown connected to the drive cylinders 34 of pump unit I and to the drive cylinders 34 of pump unit II. Pumping units I and II can operate as individual pumps as previously disclosed in patent application Ser. No. 06/133,948, filed Mar. 25, 1980, and application Ser. No. 06/309,979, filed Oct. 8, 1981, so reference is made to these applications for additional discussions.

In both pumps I and II, the pistons of cylinder 34 are sequentially driven by valve 132 in a one direction with a trapped fluid in turn sequentially driving the piston in a second direction, thus the cylinders 34 are powerly reciprocated to power the mud pumps of pump I and II. Pump unit II is arranged to pump mud with the piston rod in compression, while pump unit I is arranged to pump mud with the piston rod mainly in tension, thus different controls are necessary for controlling the pressure within the trapped fluid sections of cylinder 34 of the two pumping units. For either pump I or II, the trapped fluid must be continually supplied with a small quantity of make up fluid at a pressure higher than that pressure that is required to move the piston against its load, with its load being in the direction being moved by the trapped fluid; also, the trapped fluid must be continually supplied with cooling fluid. Thus for pumping unit II, its load is the suction force necessary to pull the mud into the mud pumping chamber of the mud pumping cylinder which is a relatively small and a relatively constant load, hence pressurized fluid is pumped into the closed chamber of cylinders 34 by an auxillary pump assembly 144 through lines 159, 160, and 161 and the excess fluid is pumped out of the closed chambers across check valve 146 by the force of the driving fluid admitted to the other end of cylinder 34 by valve 132, with check valve 146 being pre-determined to retain a sufficient pressure as required before dumping. Assembly 144 consists of a small pump driving a smaller motor with the pump being driven by an auxillary power source 143. The purpose of this arrangement is to continually supply and discharge a small quantity of fluid to the trapped fluid for cooling and to continually supply a small quantity of fluid to the trapped fluid for make up. With the pump and motor assembly 144 this can be accomplished with very little horsepower loss or heat generated since the motor helps drive the pump.

In pumping unit I the load that the trapped fluid must move against depends upon the pressure of the mud being pumped since the piston rod must move against this pumping pressure, therefore, the trapped fluid pressure requirement is variable and thus to allow continual dumping of the trapped fluid without excessive pressure surges requires a more eloborate arrangement than that shown for pumping unit II. Hence, a gas charged accumulator 139, a relief valve 138, a variable flow control valve 136, and a one way check valve 137 are employed to allow continual dumping of the trapped fluid. In operation, the accumulator always senses the pressure required of the trapped fluid, thus whenever the trapped fluid is too large in quantity the driving fluid from valve 132 will start to rapidly increase the pressure of the trapped fluid, this allows a small quantity of fluid to flow through the pilot line 153 of relief valve 138 to accumulator 139, this will in turn allow relief valve 138 to dump the excess trapped fluid rapid enough to keep the pressure rise at a minimum. Valve 136 being adjusted to allow a slower increase in the pressure within accumulator 139. Thus the dumping process while operating will be a continual process of dumping excess fluid from the trapped chambers at a predetermined pressure rise that is fairly low and is continually a fairly constant rise above the pressure requirement of the trapped fluid.

A small pump and a slightly smaller motor assembly 144 is used to supply and discharge cooling fluid to the trapped fluid chamber of pumping unit I through lines 151, 155, and 156. The function of assembly 144 is identical to the function as already explained for pump unit II, so further explantion is not necessary.

In operation, valve 132 is continually driven, as is main hydraulic pump 125 and hydraulic makeup pumping assemblies 144. The main hydraulic pump 125 is adjusted to zero output at start up, thus neither mud pump will be operating. With either mud pump operating the input flow to the trapped fluid side of cylinder 34 will bring this pressure up to the pressure necessary to move the pistons of cylinder 34 and then will slowly move the pistons and expanding the trapped fluid chambers. Likewise, in the main hydraulic system, charge pump 127 will charge the complete system to the setting of low pressure relief valve 131. Thusly, as main hydraulic pump 125 is adjusted to start pumping, pressurized fluid will be metered through valve 132 to cylinders 34 to sequentially stroke cylinders 34 in an overlapping manner to cause the mud pumping cylinders to pump an amount of mud with the mud pumping rate being directly proportional to the hydraulic fluid flow and being at a ratio that is determined by the mud piston diameter as compared to the piston diameter of cylinder 34. The rate of increasing flow and the rate of decreasing flow output from main pump 125 is controlled so that the pistons of cylinder 34 have time to achieve centered alignment timing before main pump 125 reaches full volume. Thus as the flow rate of pump 125 is decreased, the pistons of cylinder 34 will always assume a centered position within cylinder 34, or they will be in a position with the dead ended chamber of cylinder 34 expanded, in either case the pistons will be in a position to receive fluid from valve 132 and increase stroke length without reaching a dead ended position. Thus cylinders 34 can be powerly reciprocated in a smooth and sequential manner, or the reciprocation can be smoothly stopped or started or controlled to operate at any given stroke length, by controlling the fluid rate of pump 125. Flow meter 201 of the hydraulic circuit meters and indicates the fluid flow through pump 125. Thus the mud pumping flow rate will also be known since as previously shown, the mud flow rate is a direct ratio to the hydraulic fluid flow rate.

The hydraulic flow lines connecting valve 132 to cylinder 34 each have a shutoff valve (valves 134, 135, 145, 146, 199 and 200). These are simply open and shut type valves and can be employed to isolate either pump I or pump II as selected. Note on the hydraulic circuit of FIG. 5 that hydraulic cylinder 34 of pump I is connected through valve 132 to be pressurized the same as is a hydraulic cylinder 34 of pump II, thus the fluid flow can be selectively directed to either or both cylinders 34 as chosen and the cylinder drive circuit can still function in an operational manner.

Figure 4:
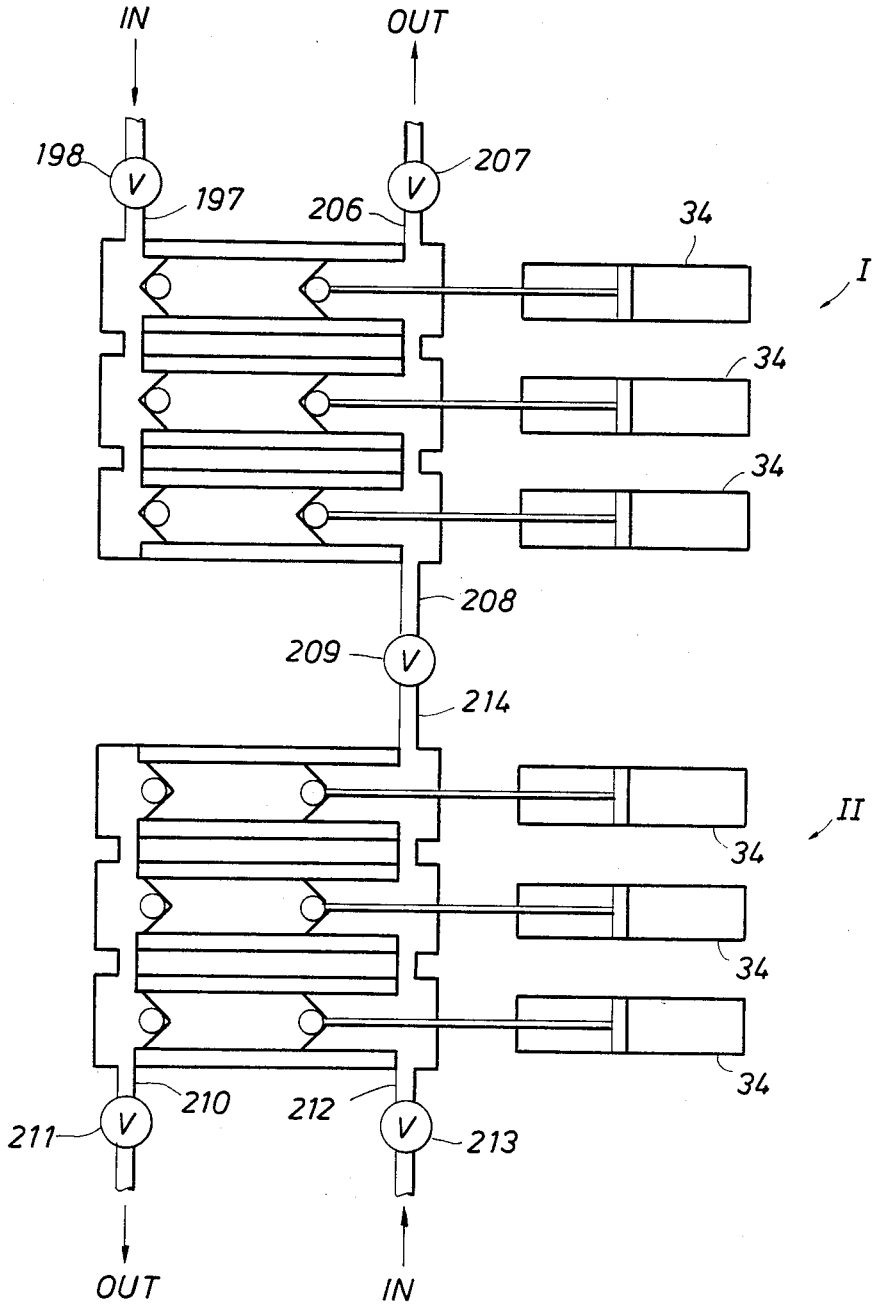
FIG. 4 is a schematic drawing representing the pumping sections of FIG. 1 and more clearly illustrating the flow path of the pumped mud through this pump.

Attention is next directed to FIG. 4 which is an expanded block type diagram of pump I and II. The mud pumping valves are illustrated in this view by unidirectional check valve symbols. In FIG. 4, pump I contains an inlet mud line 197 that has a shut off valve 198, a mud outlet line 206 that has a shut off valve 207, and a second mud outlet line 208 that has a shut off valve 209. Correspondingly, mud pump unit II has a mud inlet line 212 that contains a shut off valve 213, a mud outlet line 210 that contains a shut off valve 211, and a mud inlet line 214 that contains shut off valve 209.

It will be observed that, by selectively opening and closing mud valves on the inlet and outlet mud lines, pump I or pump II can be operated separately, or pump I and pump II can be operated in parallel, or pump I and pump II can be operated in series. It will also be noted that when pump I and pump II are operated in series, then the pressure is stepped up accordingly, thus there will be a much smaller pressure differential across the mud valves and pumping packers than would be experienced if only one pump was employed to raise the pressure by the same amount. Thus the pump of this invention is extremely versatile and capable of greater capacities, flow wise and pressure wise than convential mud pumps.

It will be noted that either the shut off valves on the hydraulic system or the mud valves on the incoming and outgoing mud lines can be employed to select the mud pump to be operated. It will also be noted that pump I and pump II can be pumps of differing capacities flow wise and pressure wise thus allowing practically endless arrangement combinations therebetween. It will also be noted that pump I and pump II could be interchanged, or both pumps could be a pump of the pump II type with the piston rod in compression, or both pumps could be a pump of the pump I type with the piston rod primairly in tension.

The hydraulic pump 125 that is employed as the main pumping unit is preferred to be a piston pump of the type that is commonly employed for use as the pumping unit of a hydrostatic transmission whereby the charge pump, relief valve, and many control features are built into the unit. These pumps employ a swash-plate that changes the pumping volume by changing the swash-plate angle, with the swash-plate angle being controlled by hydraulic pistons. These pumps have commercially available a wide range of pressure and flow control devices whereby anyone versed in the art can employ these devices, or employ these combined with other commercially available controls, to remotely or other-wise command the hydraulic pump to perform many and varied output flow or pressure control functions. It has been shown that the mud output of the pump of this invention is a direct duplication, with a given multiplacation factor applied, of the hydraulic output of the main hydraulic pump. Thus control features that are adaptable to control the pumped hydraulic fluid of pump 125 will likewise control the pump mud fluid in corresponding manner. Thus a wide range of mud pumping pressure and flow controls become available with this pump which previously have been extremly diffuclt to accomplish. These controls are too many and varied to attempt to discuss in this disclosure, however, I will discuss one such device as follows: a check valve 215 with a pre-determined pressure release is located on the outlet line of high pressure relief valve 130, consequently when fluid flow crosses valve 130 then a portion of this flow will be routed through line 168, through lock valve 216, and through line 171 to the swash-plate control piston of main pump 125 to destroke pump 125 and maintain the volume output of pump 125 at the volume required to exceed the relief valve setting of relief valve 130. Thus you can control relief valve 130 with a second panel mounted relief valve and remotely adjust to destroke pump 125 at whatever pressure you select which in turn will control the limitation upon the pumped mud pressure. Thus you can remotely command the mud pump of this invention to pump only to a selected pressure, with this selected pressure being adjustable up or down during pumping operation. Line 172 dumps control fluid from the second swash-plate piston of pump 125 so that the fluid passing through line 171 can move the swash-plate as dictated. Simular techniques can be employed to control flow rates, horsepower limitation or various and sundry mud pump compounding applications. To this end the pumping station that I have disclosed is a extremly versatile and controllable fluid pumping system that is relatively simple and can effectively and in a practical manner to be continually operated to transmit a high horsepower capacity.

The foregoing is directed to the preferred embodiment but the scope of the present invention is determined by the claims which follows:

I claim:

1. In a positive displacement pump having two or more pumping cylinders wherein each said pumping cylinder has a piston slidably and sealingly mounted therewithin, each said piston being carried by a piston rod sealingly mounted for concentric reciprocation within said pumping cylinder the improvement comprising:

(a) each said piston carrying a unidirectional flowthru valve wherein each said valve allows fluid to pass therethrough said piston in one direction only of fluid movement, with said fluid movement being relative to said piston directional movement;

(b) said pumping cylinders interconnected fluidly to thereby form an enclosed chamber that is bounded dynamically in volume by each said piston wherein fluid passing through said flowthru valve of a first said piston will move into said chamber and whereby fluid exiting from said chamber must pass through said flowthru valve of the second said piston, and;

(c) reciprocation of either or both of said first or said second pistons causes pumping of fluid therethrough said first and said second pistons and therethrough said chamber.

2. In a pump drive apparatus comprising at least four cylinders, each said cylinder having a piston slidably and sealingly disposed therein, cylinder spaces at one side of each said piston of a first half of the total number of cylinders being interconnected for fluid flow therebetween, the cylinder spaces at one side of each said piston of the second half of the total number of said cylinders being interconnected for fluid flow therebetween, the cylinder spaces at the other side of each said piston being connected to an independently operated control valve means for controlling introduction of pressurized fluid thereto and for controlling removal of fluid therefrom, said introduction of pressurized fluid and said removal of fluid being simultaneous to both said first half of said cylinders and to said second half of said cylinders, said independently operated control valve means being operable independently from said piston movement and position to permit introduction of pressurized fluid to said other side cylinder spaces in sequential turn to drive each said piston in said one cylinder and to permit removal of fluid from said other side cylinder spaces in sequential turn by movement of each said piston in said other direction, each said piston being moved in said other direction in sequential turn by fluid driven from one or more of said one side cylinder spaces by one or more of said pistons moving in said one direction, connection means to each said piston for delivering drive output derived from said piston movement, means to apply drive fluid to said innerconnected cylinder spaces of said first half of cylinders, means to apply drive fluid to said innerconnected cylinder spaces of said second half of cylinders, means to powerly drive said independently operated control valve, and means to supply a controlled volume of positive displaced fluid to said independently operated control valve to cause said pistons to reciprocally and powerly stroke in a sequential manner and with a controlled stroke length, with one or more of said pistons of said first half of cylinders and one or more of said pistons of said second half of cylinders being powerly stroked in unison.

3. The pump drive apparatus of claim 2 wherein said innerconnected cylinder spaces of said first half of cylinders are connected to said innerconnected cylinder spaces of said second half of cylinders, with one or more of said pistons of said first half of cylinders and one or more of said pistons of second half of cylinders being powerly stroked in unison.

4. The pump drive apparatus of claim 2 wherein said means to supply a controlled volume of positive displaced fluid consists of a constant displacement hydraulic pump driven by a variable speed motor.

5. The pump drive apparatus of claim 2 wherein said means to supply a controlled volume of positive displaced fluid consists of a variable displacement hydraulic pump powered by a drive motor.

6. The pump drive apparatus of claim 5 wherein said independently operated control valve is a rotary valve means containing a continually rotating fluid distribution spool, with said spool providing continual fluid communication between said positive displaced fluid supply means and two or more of said other side cylinder spaces, said continual rotation of said spool being independent of the movement and positions of said pistons to thereby allow piston synchronization means and piston stroke length control means, said piston stroke length being controlled by said controlled volume of positive displaced fluid, with the stroke length being zero at zero fluid flow and with the maximum stroke length occurring at maximum flow of said controlled volume of positive displaced fluid, and said piston synchronization being achievable in a smooth transition at or near zero piston stroke length.

7. The pump drive apparatus of claim 6, wherein said independently operated control valve comprises said fluid distribution spool sealingly and rotatably enclosed within a housing, said spool arranged to continually receive said positive displaced fluid from one or more inlet ports therethrough said housing, and to distribute said positive displaced fluid to at least four cylinder ports equally spaced around the circumference of said housing, said positive displaced fluid being distributed simultaneously to one or more pairs of said cylinder ports with said distribution being uninterrupted to each said pair of cylinder ports, said spool further being arranged to gather discharge fluid simultaneously from one or more pairs of said cylinder ports and to continually discharge said gathered fluid to a fluid return port passing therethrough said housing, said gathering of said discharge fluid being in a like manner from each said pair of cylinder ports to provide a flow of said discharge fluid to said return port, said cylinder ports being connected to said cylinder spaces at said other side of each piston with one cylinder port of a said pair of cylinder ports being connected to said first half of cylinders, and with the second cylinder port of a said pair of cylinder ports being connected to said second half of cylinders, said spool having shaft connection means at one end for driving means connection thereto, with said spool being formed whereby all pressure annulars leading from the circumference have offsetting pressurized spaces of equal magnitude to hydrostatically counterbalance said spool for pressurized unrestrained rotation within said housing.

8. The pump drive apparatus of claim 2 whereby said connection means to each piston for delivering drive output derived from said piston movement consists of a shaft means connecting to said piston and extending through one end of said cylinder.

9. The pump drive apparatus of claim 8 wherein said shaft means drives pump means.

10. The pump drive apparatus of claim 9 wherein said pump means are each comprised of a single piston or plunger type positive displacement pump, with said single pump containing at least two fluid pumping chambers, the piston or plunger of each said fluid pumping chamber being reciprocally driven by a cylinder of either said first half of cylinders or said second half of cylinders.

11. The pump drive apparatus of claim 9 wherein said pump means comprises a piston type positive displacement pump containing at least two fluid pumping chambers, each said chamber being fitted with a first unidirectional flow valve for one direction fluid flow therethrough, each said chamber additionally encasing a second unidirectional flow valve for one direction fluid flow therethrough with said second flow valve being carried by a piston assembly, said piston assembly being arranged to pump fluid in one direction of piston travel and being arranged to pass fluid therethrough in the second direction of piston travel, with said fluid flowing therethrough said second flow valve in said second direction of piston travel, said first unidirectional flow valve being arranged to allow fluid flow therethrough when said piston assembly travels in said one direction to pump fluid, said piston assembly of each said pumping chamber being carried by said shaft means and being reciprocally driven by a cylinder of either said first half of cylinders or said second half of cylinders, and each said fluid pumping chamber having fluid inlet means thereto and fluid exhaust means therefrom for pumping of fluid therethrough upon reciprocation of said shaft means.

12. The pump drive apparatus of claim 9 wherein said pump means comprises two separate piston type positive displacement pumps with each said positive displacement pump containing at least two fluid pumping chambers with each said chamber being fitted with a first unidirectional flow valve for one direction fluid flow therethrough, each said chamber additionally encasing a second unidirectional flow valve for one direction fluid flow therethrough with said second flow valve being carried by a piston assembly, said piston assembly being arranged to pump fluid in one direction of piston travel and being arranged to pass fluid therethrough in the second direction of piston travel with said fluid passing therethrough said second flow valve in said second direction of piston travel, said first unidirectional flow valve being arranged to allow fluid flow therethrough when said piston assembly travels in said one direction to pump fluid, said piston assembly of each said pumping chamber of first said separate pump being carried by said shaft means and being reciprocally driven by a cylinder of said first half of cylinders, said piston assembly of each said pumping chamber of second said separate pump being carried by said shaft means and being reciprocally driven by a cylinder of said second half of cylinders, and each said fluid pumping chamber having fluid inlet means thereto and fluid exhaust means therefrom for pumping of fluid therethrough upon reciprocation of said shaft means.

13. The pump drive apparatus of claim 12 wherein said two separate pumps are connected to pump fluid in a parallel flow pattern whereby the total volume of fluid pumped is the volume of said first separate pump plus the volume of said second separate pump.

14. The pump drive apparatus of claim 12 wherein said two separate pumps are connected to pump fluid in a series flow pattern whereby said first separate pump supplies to said second separate pump a given quantity of pumped fluid at a given pressure, and said second separate pump extends the pressure of said given quantity of pumped fluid.

15. The pump drive apparatus of claim 9 wherein said pump means comprises two separate piston or plunger type positive displacement pumps, with each pump containing at least two fluid pumping chambers, the piston or plunger of each said fluid pumping chamber of the first said separate pump being reciprocally driven by a cylinder of said first half of cylinders; and the piston or plunger of each said fluid pumping chamber of the second said separate pump being reciprocally driven by a cylinder of said second half of cylinders.

16. The pump drive apparatus of claim 15 wherein said two separate pumps are connected to pump fluid in a parallel flow pattern whereby the total volume of fluid pumped is the volume of said first separate pump plus the volume of said second separate pump.

17. The pump drive apparatus of claim 15 wherein said two separate pumps are connected to pump fluid in a series flow pattern whereby said first separate pump supplies to said second separate pump a given quantity of pumped fluid at a given pressure, and said second separate pump extends the pressure of said given quantity of pumped fluid.

18. In a pump:

a head flange member containing a circular bore therethrough;

a removable valve housing positioned within said bore, said removable housing containing unidirectional flow valve means for one direction fluid flow therethrough, a replaceable pumping cylinder extending inward from said head flange member and with a piston bore housing a reciprocally actuated pumping rod carrying piston means reciprocable in said piston bore;

said head flange member containing alignment means to position said removable housing within said circular bore, end positioning means of said removable housing to sealingly align one end of said pumping cylinder with said piston bore concentric to the centerline of said reciprocally actuated pumping rod;

said removable housing constructed with passages to provide sealed fluid communication between said piston bore of said pumping cylinder and said unidirectional flow valve means;

said removable housing further having sealed passage means to provide a fluid communication for fluid flow between a connecting flow conduit and said unidirectional flow valve means; and said removable housing additionally having connection means with said head flange member to thereby rigidly position said removable housing with respect to said head flange member.

19. The combination of claim 18, whereby the circumferential sealed diameter of the said sealingly aligned pumping cylinder is of smaller diameter than that of said circular bore to thereby lessen the force required to retain said connection means between said removeable housing and said head flange, said lessening being in relation to the force that would normally be required to cap said circular bore against a pumped pressure within said circular bore.

20. The combination of claim 18, whereby said circular bore through said head flange member is aligned by spacing means for concentric alignment there-with to said centerline of reciprocally actuated pumping rod, said removable housing being a rounded elongated member with a raised diameter part near each end, said raised diameters parts each being fitted with a seal element and each said part being formed to slidingly and sealingly mate with a smooth circumferential surface of said circular bore to thereby align the longitudinal centerline of said removable housing to be concentric to the centerline of said circular bore, said end positioning means of said removable housing consisting of a conical taper on the inner end of said removable housing that sealingly aligns with and positions a corresponding conical taper that is formed upon said one end of said pumping cylinder, said taper on the inner end of said removable housing being formed with the centerline of the taper being concentric to said longitudinal centerline therethrough of said removable housing, and the said taper on the said one end of the pumping cylinder being formed with the taper's centerline being concentric to the centerline of said piston bore, said one end of said pumping cylinder further being fitted with a seal means at said taper to provide said sealed fluid communication between said piston bore of said pumping cylinder and said unidirectional flow valve means, said removable housing further containing a recessed groove around its circumference with said groove being positioned between said raised diameters parts, said groove being constructed to define sealed fluid communication between said connecting flow conduit and said unidirectional flow valve, and said connecting flow conduit consisting of one or more fluid ports leading through a side of said head flange member and in turn connecting to a fluid flow line.

21. The combination of claim 20, whereby said connection means with said head flange member consists of threaded lugs mounted in the outer end of said head flange, said lugs in turn carrying an end plate with said end plate in turn pressing against the outer end of said removable housing to secure said removable housing when nuts upon said threaded lugs are rightened against said end plate.

22. The combination of claim 20, whereby said raised diameter parts near each end of said removable housing are diameters of differing circumferences, with the circumference of said raised diameter part nearest said inner end of said removable housing being the smaller circumference whereby said raised diameter parts near each end of said removeable housing are diameters of differing circumferences to facilitate assembly of said pump.

23. The combination of claim 20, whereby said conical taper on the inner end of said removable housing is fitted with a wear ring to protect said taper from erosion as fluid flow passes thereby, said wear ring formed at one end to mate with said taper on the inner end of said removable housing, and said wear ring formed on its outer circumference to mate with the bore of said pumping cylinder and further to mate with a circumferential chamfer that is formed upon the end of said pumping cylinder, and with said wear ring being retained in place by said circumferential chamfer of said pumping cylinder.

24. The combination of claim 20, whereby said head flange member carries tie rods, said tie rods connecting to an end flange, a spacer member positioned between said head flange and said end flange, said spacer being retained in place by said tie rods, said end flange containing a central bore therethrough into which is fitted a rod seal housing, said rod seal housing sealing between said housing and said reciprocally actuated pumping rod, said spacer being formed to concentrically align said circular bore of said head flange with the centerline of said reciprocally actuated pumping rod, said end flange carrying on its inner end a second conical taper, with said second conical taper having its centerline concentric with the centerline of said reciprocally actuated pumping rod, said second concial taper in turn being formed to sealingly align with and position a corresponding conical taper that is formed upon a second end of said pumping cylinder, said conical taper upon said second end of said pumping cylinder being formed with its centerline concentric to said piston bore therethrough, said end flange further containing one or more fluid ports positioned through a side thereof and with said fluid ports providing annular communication with said central bore of said end flange, said conical taper on the said second end of said pumping cylinder further containing seal means to provide a sealed fluid annular communication passage between said piston bore of said pumping cylinder and said fluid ports of said end flange.

25. The combination of claim 24, whereby the said second conical taper carried on the inner end of said end flange is fitted with a wear ring to protect said second conical taper from erosion as fluid flow passes thereby, said wear ring formed at one end to mate with said second conical taper and its outer circumference formed to mate with the piston bore of said pumping cylinder and to mate with a circumferential chamfer upon the end of said piston bore of said pumping cylinder, and with said wear ring being retained in place by said circumferential chamfer of said pumping cylinder.

26. The combination of claim 24, whereby the said second conical taper on the inner end of said end flange is a taper formed upon one face of a removable end ring, said end ring being sealingly positioned within a recessed counterbore that is centrally formed upon the said inner end of said end flange, and said end ring secured in place by said second end of said pumping cylinder.

27. The combination of claim 24, wherein said unidirectional flow valve means is an inlet flow valve for one direction flow of inlet fluid therethrough, said inlet flow valve being positioned to receive fluid flow from at least one of said fluid ports leading through a side of said head flange member, and said inlet flow valve being positioned to discharge fluid into said piston bore of said pumping cylinder.

28. The combination of claim 26, wherein said unidirectional flow valve means is an outlet flow valve for one direction flow of pressurized fluid therethrough, said outlet flow valve being positioned to receive fluid flow from said piston bore of said pumping cylinder, and said outlet flow valve being positioned to discharge fluid into at least one of said fluid ports leading through a side of said head flange member.

29. The combination of claim 27, whereby said reciprocally actuated piston means carries a pliable piston packer sealing with said piston bore and an integral unidirectional valve member, and said piston packer and said valve member arranged to cause fluid to be pulled across said unidirectional inlet flow valve means and into said pumping cylinder, through said valve member and then discharged through said fluid ports of said end flange as said reciprocally actuated pumping rod is powerly driven in a reciprocating manner by a driving means.

30. The combination of claim 29, whereins said driving means includes a hydraulic driven cylinder that is carried by an adaptor flange, said adaptor flange attached to the outer end of said end flange, said adaptor flange being arranged to align the piston rod of said hydraulic cylinder for concentric actuation therewith to the centerline of said piston bore of said pumping cylinder, and with said piston rod of said hydraulic cylinder integral with said reciprocally actuated pumping rod.

31. The combination of claim 30, whereby said piston rod of said hydraulic cylinder comprises a replaceable outer sleeve member carried by an inner rod member, said inner rod in turn being carried by the drive piston of said hydraulic cylinder, said inner rod arranged to align and sealingly retain said outer sleeve within the confines of said hydraulic cylinder and said inner rod extending to within the bore of said pumping cylinder, said outer sleeve being replaceable without the removal of said inner rod from said drive piston, and said outer sleeve being replaceable without the removal of said drive piston from said hydraulic cylinder.

32. The combination of claim 28, whereby said reciprocally actuated pumping piston means carries a pliable piston packer and an integral unidirectional valve member, and said piston packer being arranged to cause fluid to be pulled across said integral unidirectional valve member and into said pumping cylinder and then discharged through said unidirectional outlet flow valve as said reciprocally actuated pumping rod is powerly driven in a reciprocating manner by a driving means.

33. The combination of claim 32, said driving means includes hydraulic driven cylinder that is carried by an adaptor flange, said adaptor flange attached to the outer end of said end flange, said adaptor flange being arranged to align the piston rod of said hydraulic cylinder for concentric actuation therewith to the centerline of said piston bore of said pumping cylinder, and with said piston rod of said hydraulic cylinder integral with said reciprocally actuated pumping rod.

34. The combination of claim 33, whereby said piston rod of said hydraulic cylinder comprises a replaceable outer sleeve member carried by an inner rod member, said inner rod in turn being carried by the drive piston of said hydraulic cylinder, said inner rod arranged to align and sealingly retain said outer sleeve with said outer sleeve commencing within the confines of said hydraulic cylinder and said inner rod extending to within the bore of said pumping cylinder, said outer sleeve being replaceable without the removal of said inner rod from said drive piston, and said outer sleeve being replaceable without the removal of said drive piston from said hydraulic cylinder.

35. Drive apparatus for the pump of claim 18 comprising at least six cylinders, each cylinder having a piston slidably and sealingly disposed therein, the cylinder spaces at one side of each piston of a first half of the total number of cylinders being interconnected for fluid flow therebetween, the cylinders spaces at one side of each piston of the second half of the total number of cylinders being interconnected for fluid flow therebetween, the cylinder spaces at the other side of each piston being connected to an independently operated control valve means for controlling introduction of pressurized fluid thereto and for controlling removal of fluid therefrom, said introduction of pressurized fluid and said removal of fluid being simultaneous to both said first half of cylinders and to said second half of cylinders, said independently operated control valve means being operable independently from said piston movement and position to permit introduction of pressurized fluid to said other side cylinder spaces in sequential turn to drive each said piston in said one direction and to permit removal of fluid from said other side cylinder spaces in sequential turn by movement of each piston in said other direction, each said piston being moved in said other direction in sequential turn by fluid driving from one or more of said one side cylinder spaces by one or more of said pistons moving in said one direction, connection means to each said piston for delivering drive output derived from said piston movement, means to apply drive fluid to said innerconnected cylinder spaces of said first half of cylinders, means to apply drive fluid to said innerconnected cylinder spaces of said second half of cylinders, means to powerly drive said independently operated control valve, and means to supply a controlled volume of positive displaced fluid to said independently operated control valve to cause said pistons to reciprocally and powerly stroke in a sequential manner and with a controlled stroke length, with one or more of said pistons of said first half of cylinders and one or more of said pistons of said second half of cylinders being powerly stroked in unison, and said pistons connected with said reciprocally actuated pumping rods of said pump.

36. The combination of claim 35, said innerconnected cylinder spaces of said first half of cylinders being connected to said innerconnected cylinder spaces of said second half of cylinders, with one or more of said pistons of said first half of cylinder and one or more of said pistons of second half of cylinders being powerly stroked in unison.

37. The combination of claim 35, said means to supply a controlled volume of positive displaced fluid consisting of a constant displacement hydraulic pump driven by a variable speed motor.

38. The combination of claim 35, said means to supply a controlled volume of positive displaced fluid consisting of a variable displacement hydraulic pump powered by a drive motor.

39. The combination of claim 38, wherein said independently operated control valve is a rotary valve means containing a continually rotating fluid distribution spool, with said spool providing continual fluid communication between said positive displaced fluid supply means and two or more of said other side cylinder spaces, said continual rotation of said spool being independent of the movement and position of said pistons to thereby allow piston synchronization means and piston stroke length control means, said piston stroke length being controlled by said controlled volume of positive displaced fluid, with the stroke length being zero at zero fluid flow and with the maximum stroke length occurring at maximum flow of said controlled volume of positive displaced fluid, said piston synchronization being achievable in a smooth transition at or near zero piston stroke length.

40. The combination of claim 39, wherein said independently operated control valve comprises said fluid distribution spool sealingly and rotatably enclosed within a housing, said spool arranged to continually receive said positive displaced fluid from one or more inlet ports therethrough said housing, and to distribute said positive displaced fluid to at least six cylinder ports equally spaced around the circumference of said housing, said positive displaced fluid being distributed simultaneously to one or more pairs of said cylinder ports with said distribution being uninterrupted to each said pair of cylinder ports, said spool further being arranged to gather discharge fluid simultaneously from one or more pairs of said cylinder ports and to continually discharge said gathered fluid to a fluid return port passing therethrough said housing, said gathering of said discharge fluid being in a like manner from each said pair of cylinder ports to provide a flow of said discharge fluid to said return port, said cylinder ports being connected to said cylinder spaces at said other side of each piston with one cylinder port of a said pair of cylinder ports being connected to said first half of cylinders, and with the second cylinder port of a said pair of cylinder ports being connected to said second half of cylinders, said spool havng shaft connection means at one end for driving means connection thereto, with said spool being formed whereby all pressure annulars leading from the circumference have offsetting pressurized spaces of equal magnitude to hydrostatically counterbalance said spool for pressurized un-restrained rotation within said housing.

41. The combination of claim 35, said connection means to each piston for delivering drive output derived from said piston movement consisting of a shaft means connecting to said piston and extending through one end of said cylinder.

42. The combination of claim 41, said shaft means driving pump means.

43. The combination of claim 42, wherein said pump means comprises a single piston or plunger type positive displacement pump, said single pump containing at least three fluid pumping chambers, the piston or plunger of each said fluid pumping chamber being reciprocally driven by a cylinder of either said first half of cylinders or said second half of cylinders.

44. The combination of claim 42, wherein said pump means comprises a piston type positive displacement pump containing three or more fluid pumping chambers, each said chamber being fitted with a first unidirectional flow valve for one direction fluid flow therethrough, each said chamber additionally encasing a second unidirectional flow valve for one direction fluid flow therethrough with said second flow valve being carried integrally by a piston assembly including said piston, said piston assembly being arranged to pump fluid in one direction of piston travel and being arranged to pass fluid therethrough in the second direction of piston travel, with said fluid flowing therethrough said second flow valve in said second direction of piston travel, said first unidirectional flow valve being arranged to allow fluid flow therethrough when said piston assembly travels in said one direction to pump fluid, said piston assembly of each said pumping chamber being carried by said shaft means and being reciprocally driven by a cylinder of either said first half of cylinders or said second half of cylinders, and each said fluid pumping chamber having fluid inlet means thereto and fluid exhaust means therefrom for pumping of fluid therethrough upon reciprocation of said shaft means.

45. The combination of claim 42, wherein said pump means comprises two separate piston or plunger type positive displacement pumps, with each pump containing at least three fluid pumping chambers, the piston or plunger of each said fluid pumping chamber of the first said separate pumps being reciprocally driven by a cylinder of said first half of cylinders and the piston or plunger of each said fluid pumping chamber of the second said separate pump being reciprocally driven by a cylinder of said second half of cylinders.

46. The combination of claim 45, said two separate pumps being connected to pump fluid in a parallel flow pattern whereby the total volume of fluid pumped is the volume of said first separate pump plus the volume of said second separate pump.

47. The combination of claim 44, said two separate pumps being connected to pump fluid in a series flow pattern whereby said first separate pump supplies to said second separate pump a given quantity of pumped fluid at a given pressure, and said second separate pump extends the pressure of said given quantity of pumped fluid.

48. The combination of claim 42, wherein said pump means comprises at least two separate piston type positive displacement pumps with each said positive displacement pump containing at least three fluid pumping chambers with each said chamber being fitted with a first unidirectional flow valve for one direction fluid flow therethrough, each said chamber additionally encasing a second unidirectional flow valve for one direction fluid flow therethrough with said second flow valve being carried by a piston assembly, said piston assembly being arranged to pump fluid in one direction of piston travel and being arranged to pass fluid therethrough in the second direction of piston travel and with said fluid passing through said second flow valve in said second direction of piston travel, said first unidirectional flow valve being arranged to allow fluid flow therethrough when said piston assembly travels in said one direction to pump fluid, said piston assembly of each said pumping chamber of first said separate pump being carried by said shaft means and being reciprocally driven by a cylinder of said first half of cylinders, said piston assembly of each said pumping chamber of second said separate pump being carried by said shaft means and being reciprocally driven by a cylinder of said second half of cylinders, and each said fluid pumping chamber having fluid inlet means thereto and fluid exhaust means therefrom for pumping of fluid therethrough upon reciprocation of said shaft means.

49. The combination of claim 48, said two separate pumps being connected to pump fluid in a parallel flow pattern whereby the total volume of fluid pumped is the volume of said first separate pump plus the volume of said second separate pump.

50. The combination of claim 48, said two separate mud pumps being connected to pump fluid in a series flow pattern whereby said first separate pump supplies to said second separate pump a given quantity of pumped fluid at a given pressure, and said second separate pump extends the pressure of said given quantity of pumped fluid.

* * * * *